US006879231B2

(12) United States Patent
Menard

(10) Patent No.: US 6,879,231 B2
(45) Date of Patent: Apr. 12, 2005

(54) MAGNETIC CHUCK FOR CONVERGENCE APPARATUS

(75) Inventor: Jean Pierre Menard, Fremont, CA (US)

(73) Assignee: Aurora Systems, Inc., San Jose, CA (US)

( * ) Notice: Subject to any disclaimer, the term of this patent is extended or adjusted under 35 U.S.C. 154(b) by 366 days.

(21) Appl. No.: 09/816,951

(22) Filed: Mar. 22, 2001

(65) Prior Publication Data

US 2002/0135449 A1 Sep. 26, 2002

(51) Int. Cl.[7] ..... H01F 7/20
(52) U.S. Cl. ..... 335/289; 269/8
(58) Field of Search ..... 335/284–285, 335/289–291; 269/8; 29/281.4

(56) References Cited

U.S. PATENT DOCUMENTS 5,993,365 A * 11/1999 Stagnitto et al. ..... 483/59

6,480,347 B1 * 11/2002 Spring ..... 359/831

* cited by examiner

*Primary Examiner*—Lincoln Donovan
(74) *Attorney, Agent, or Firm*—Henneman & Saunders; Larry E. Henneman, Jr.

(57) ABSTRACT

A magnetic chuck (10) for temporarily holding an LCD imager (14) to a convergence device (12) during an alignment or convergence operation. A substrate (16) of the imager (14) is made of a magnetically permeable material. A knob (38) turns an armature assembly (22) such that in an on position 10*b* a second magnetic flux path (46*b*) is allowed to permeate the substrate 16 thereby holding the imager (14) to a grip face 18 of the magnetic chuck (10). When the knob (28) is rotated to shunt flux through a first magnetic flux path (49*a*) through a pair of steel grip shoes (20), then the imager (14) is released form the grip face (18).

27 Claims, 4 Drawing Sheets

MAGNETIC CHUCK FOR CONVERGENCE APPARATUS

TECHNICAL FIELD

The present invention relates to the field of mechanical focusing and convergence devices for optical systems, and more particularly to an improved holding apparatus for mechanical convergence fixtures for projection-type liquid crystal projectors. The predominant current usage of the inventive magnetic chuck is in commercial video projection devices wherein accuracy of adjustment, economy of manufacture and ruggedness are all important factors.

BACKGROUND ART

In a liquid crystal projector, white source light is separated into beams of its three primary colors. Each beam is then infused with an image by an imaging device, for example a miniature liquid crystal light valve (micro-LCD). Finally, the three beams are recombined into a single image and projected onto a display surface (a screen).

The micro LCD's generate a representation of the image to be projected by using many small picture elements referred to as pixels. Therefore, the above mentioned beams of light that emerge from the micro-LCD's are pixellated representations of the particular color components of the image. Thus, an accurate projected image requires that the pixels of the three infused beams be precisely aligned during the recombination step, meaning that the micro-LCD's themselves must be carefully positioned. In order to optimally orient the micro-LCD's the following requirements must be met.

(1) 6 degree of freedom (dof) adjustment capability must be available. Both rotation and linear translation with respect to three perpendicular axes are required in order to ensure that proper image alignment can be achieved.

(2) Adjustment mechanisms must have high resolution controls. Because of the small size of the pixels, direct manual adjustments are too crude to achieve proper alignment. Some sort of interface must be provided which can transform relatively large-scale operator inputs into micro-LCD motions of a magnitude commensurate with the pixel size.

(3) Adjustment mechanisms must provide positive positioning constraints. Since multiple operations are required to tune all 6 degrees of freedom, intermediate adjustments must have some amount of resistance to motion. Positioning devices typically have some sort of final locking mechanism, but to activate and deactivate that mechanism numerous times over the course of adjustment is cumbersome and often impossible. Therefore, any robust positioning device must provide for physical locating effects, rather than relying on balance, gravity or friction.

(4) The individual magnification of each image must be independently adjustable. There must be a means for making slight adjustments to the projected size of the image from any projection device. This means must be simple, inexpensive, and easy to use such that adjustments can be made quickly during the production process.

In order to achieve the above objectives, it is necessary to have some means for temporarily holding the LCD imager while the described adjustments are made. Such means should be easy to use, should not place any undue stress on the imager such that the image is distorted, and should not in any way harm the imager. It has been known to use a vacuum chuck for this purpose wherein the imager is held to a fixture apparatus by a vacuum. Other known methods have been to physically restrain the imager with a hook, or grabbing apparatus, or the like. In such methods some sort of holding force is required, and this has frequently been provided by a rubber band.

While the above attachment methods and apparatus have performed adequately for the purpose, they have all been somewhat cumbersome in some manner and/or have not held the imager as securely as might be desired. It would be desirable to have some method or means for holding an LCD imager to a fixture apparatus which holds the imager securely, releases quickly and easily, is easy and quick to use, and which does not harm the imager.

SUMMARY

Accordingly, it is an object of the present invention to provide a holding device for an optical-mechanical convergence device which will provide for accurate and easy positioning of a liquid crystal display ("LCD") in a projection apparatus.

It is still another object of the present invention to provide a method and apparatus for temporarily securing a micro-LCD which is economical to manufacture.

It is yet another object of the present invention to provide a method and apparatus for temporarily securing a micro-LCD which is rugged in that the position of the micro-LCD will not shift when subjected to normal shock and vibration.

It is still another object of the present invention to provide an apparatus and method for temporarily securing a micro-LCD while it is positioned by a convergence apparatus.

Briefly, an embodiment of the invention has a face against which an imager can rest. The substrate of the imager is selected for many other properties, but also for its magnetic permeability. The face has a pair of steel plates that are magnetically isolated from each other. There is a shaft/armature that passes between the two plates. The armature has a magnet with poles which point radially outward. When the armature is in a first orientation, the poles are facing the steel plates and the fixturing device will then firmly hold any magnetically permeable material that is placed against the face and thereby completes the magnetic circuit. When the armature is rotated ninety degrees, the poles then straddle the two steel plates. The magnetic circuit is then completed through the plates and there is no attraction at the fixture face.

An advantage of the present invention is that an LCD imager can be temporarily secured while convergence adjustments are made.

A further advantage of the present invention is that an LCD imager is held securely in place.

Another advantage of the present invention is the an LCD imager is held in place without placing any undue stress thereon.

Still another advantage of the present invention is that an LCD imager is easily and quickly affixed to a convergence adjustment apparatus.

Yet another advantage of the present invention is that an LCD imager is easily released from a convergence adjustment apparatus.

These and other objects and advantages of the present invention will become clear to those skilled in the art in view of the description of modes of carrying out the invention, and the industrial applicability thereof, as described herein and as illustrated in the several figures of the drawing. The objects and advantages listed are not an exhaustive list of all possible advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the above described objects and advantages. Accordingly, the listed advantages are not essential elements of the present invention, and should not be construed as limitations.

DETAILED DESCRIPTION

Figure 1:
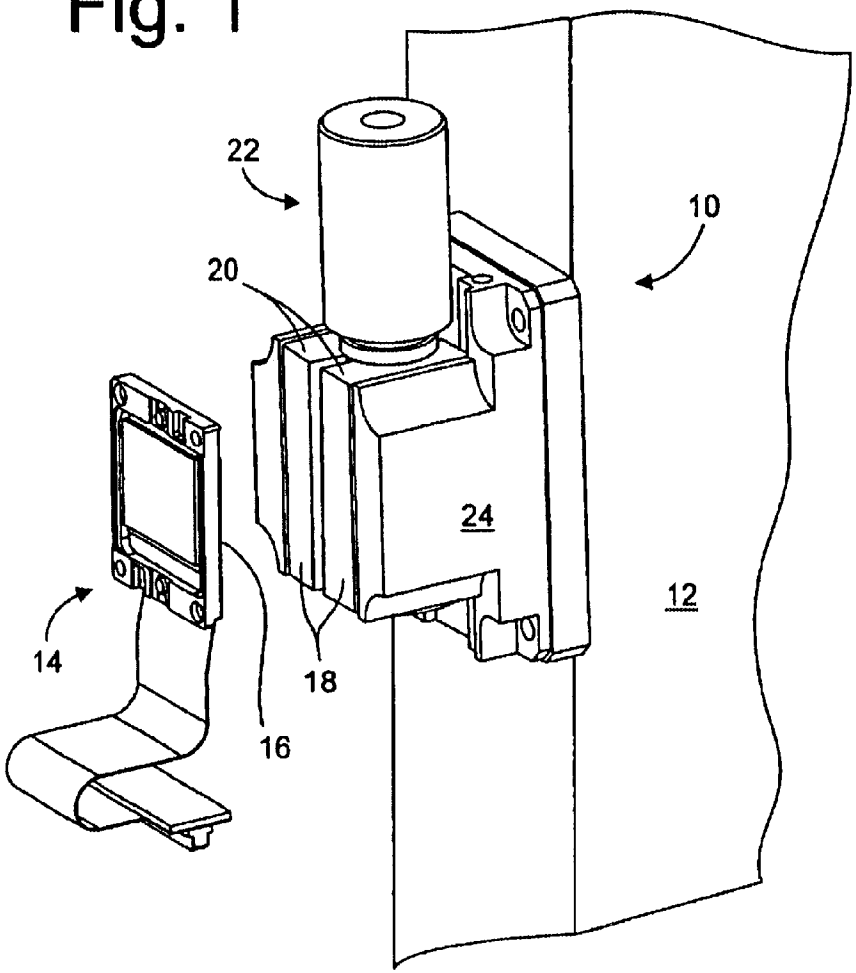
FIG. 1 is perspective view of an example of a magnetic chuck apparatus according to the present invention, shown in relation to a convergence apparatus and an LCD imager.

The embodiments and variations of the invention described herein, and/or shown in the drawings, are presented by way of example only and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

One particular embodiment of the present invention is a magnetic chuck apparatus which is shown in perspective in the view of FIG. 1 and is designated therein by the general reference character 10. In the view of FIG. 1, the magnetic chuck 10 is shown affixed to a convergence apparatus 12. The convergence apparatus 12 is not a part of the present invention, and so is not shown in great detail herein. The inventive magnetic chuck 10 can be used with essentially any such convergence apparatus 12 now in use or yet to be developed.

In the view of FIG. 1 an imager 14 is shown detached from the magnetic chuck 10. The LCD imager 14 may be of essentially any type (e.g., LCD, deformable mirror device, etc.) either known or yet to be developed, with the single exception that a substrate 16 of the imager 14 (or at least some part thereof) should be of a magnetically permeable material such that the imager 14 can be held to the chuck 10 thereby. It is intended that the imager 14 be magnetically attracted to a grip face 18 of the magnetic chuck 10, as will be described in more detail hereinafter.

Figure 2:
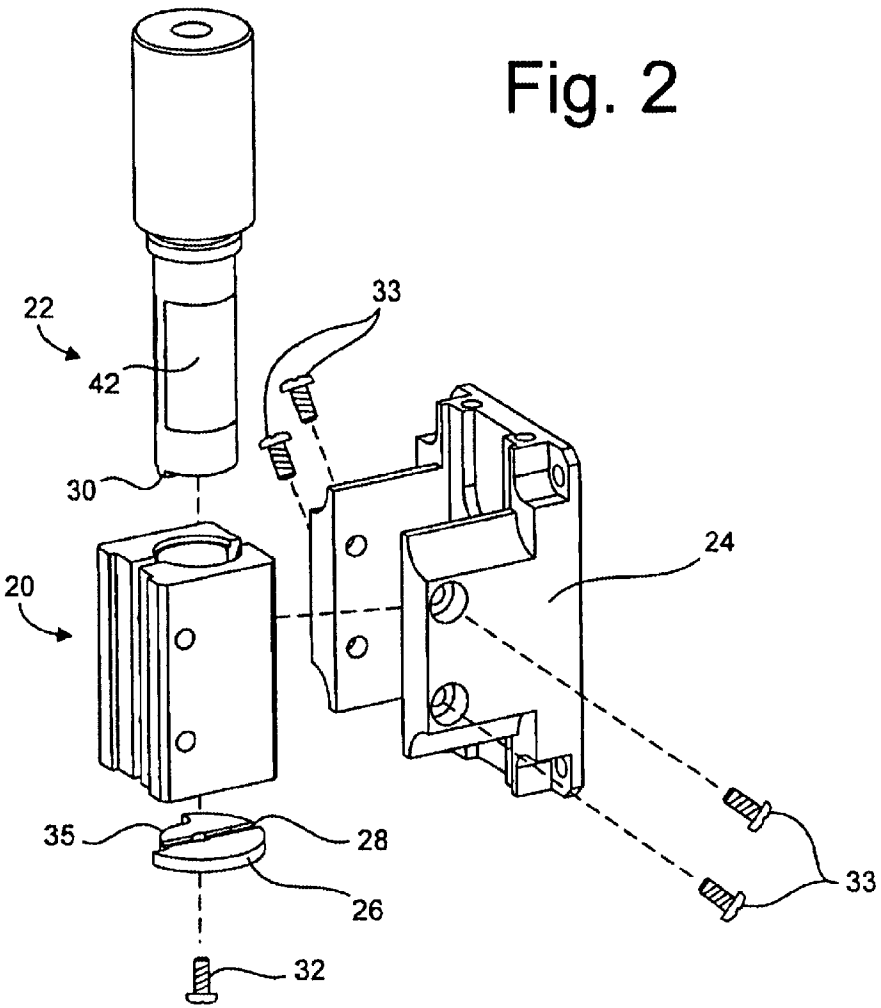
FIG. 2 is an exploded perspective view of the magnetic chuck of FIG. 1.

FIG. 2 is a partially exploded perspective view of the magnetic chuck 10 of FIG. 1. In the view of FIG. 2 can be seen two steel grip shoes 20, an armature assembly 22, an aluminum frame 24, and an aluminum retainer and travel limiter 26. A groove 28 in the retainer 26 is adapted for accepting a ridge 30 on the armature assembly 22 and the retainer 26 is secured to the armature assembly 22 by a retainer screw 32. A plurality (four, in this present example) of shoe screws 33 secure the two steep grip shoes 20 to the aluminum frame. As can be appreciated from the views of FIGS. 1 and 2, when the magnetic chuck 10 is assembled, the armature assembly 22 is free to turn between the steel grip shoes 20 within the limits imposed by the shape of the retainer 26. The particular range of motion will be discussed in more detail hereinafter.

Figure 3:
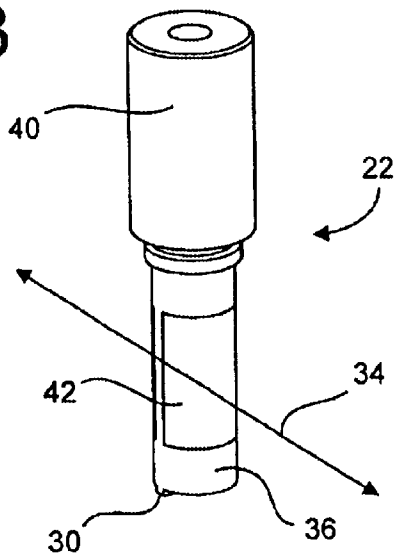
FIG. 3 is a perspective view of the armature assembly of FIG. 2.

FIG. 3 is a perspective view of the armature assembly 22 showing a magnetic pole direction indicator arrow 34 which represents the North/South alignment of the magnetic poles. Which end of the indicator arrow 34 represents North and which end indicates South is not relevant to the invention, and so is not shown in the view of FIG. 3.

Figure 4:
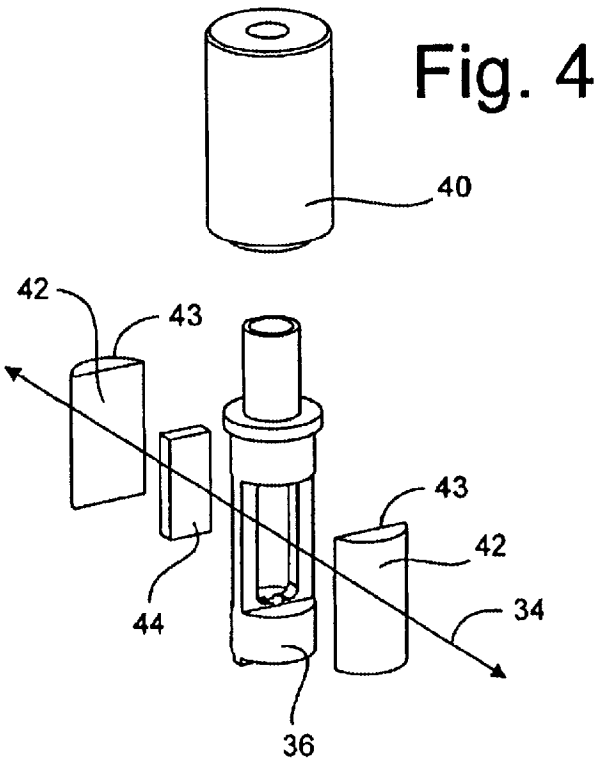
FIG. 4 is an exploded perspective view of the armature assembly of FIG. 2.

FIG. 4 is an exploded perspective view of the armature assembly 22. As can be seen in the view of FIG. 4, the armature assembly 22 has an aluminum (non-magnetic) shaft 36. In this description of the invention where parts are called out as being made of aluminum, it should be understood that essentially any type of non-magnetic material that is otherwise suitable for construction of those particular parts could be substituted for the aluminum. Similarly, it should be understood that other types of magnetic material might be substituted for the steel parts described herein. The aluminum shaft 36 has affixed thereto a knob 40 whereby the armature assembly 22 can be manually rotated by a user.

Fit within the aluminum shaft 36 are two steel pole pieces 42 with a magnet 44 disposed therebetween. In this particular embodiment, pole pieces 42 are cylindrical solids having faces 43 in the shape of segments of a circle. Thus, when magnet 44 and pole pieces 42 are mounted in armature assembly 22, armature assembly 22 has a shape that corresponds to the shape bounded by the interior surfaces of grip shoes 20. In the particular embodiment shown, the assembled armature assembly 22 and the shape bounded by the interior surfaces of grip shoes 20 are both circular cylinders, but this particular geometry is not an essential element of the invention. What is important is that the shapes of the armature assembly 22 and grip shoes 20 correspond in such a way that when armature assembly 22 is in one position the magnetic field passes through grip faces 18 to magnetically engage imager 14, and when armature assembly 22 is in a second position, the magnetic flux is shunted through grip shoes 20 (or some other shunting circuit).

Figure 6:
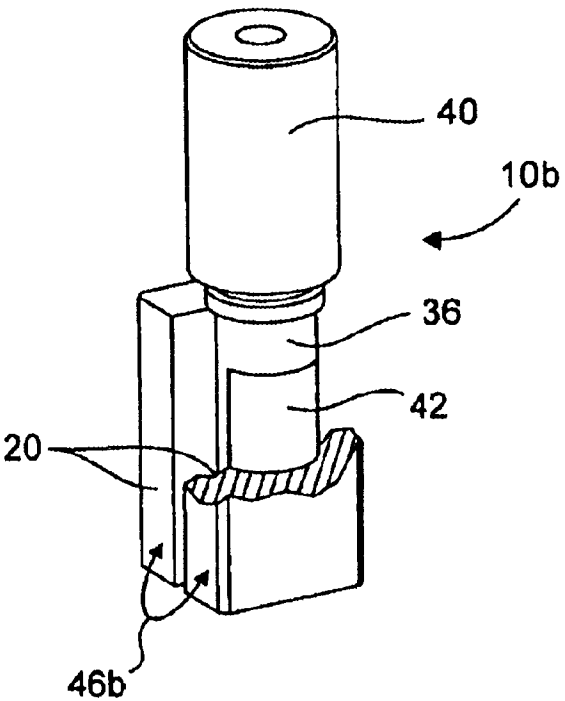
FIG. 6 is a cut-away view of an example of a magnetic chuck, according to the present invention, in an on position.
Figure 5:
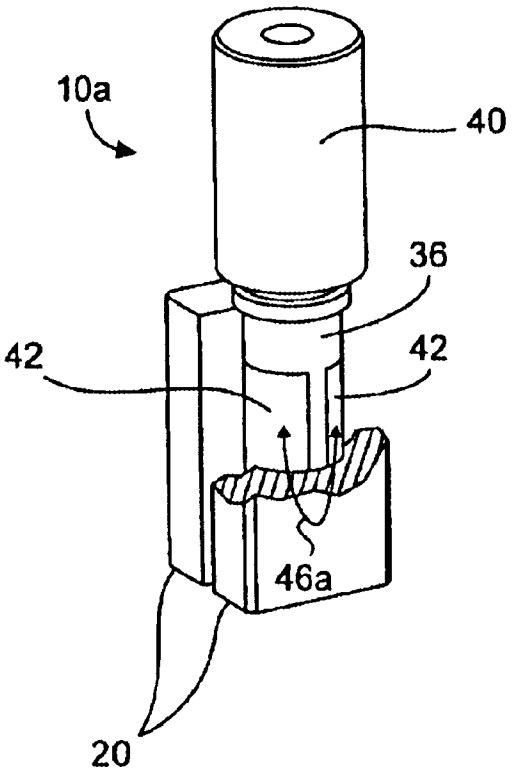
FIG. 5 is a cut-away view of an example of a magnetic chuck, according to the present invention, in an off position.

FIG. 5 is a partially cut-away, perspective view of an example of the inventive chuck in an off position 10*a* and FIG. 6 is a view of an example of the inventive chuck in an on position 10*b*. As can be appreciated by one skilled in the art, when the knob 38 is turned such that the steel poles 42 are in the position shown in the view of FIG. 10*a*, then a first magnetic flux path 46*a* is routed through the steel grip shoes 20. Alternatively, when the steel poles 42 are in the position shown in the view of FIG. 10*b*, then a second magnetic flux path 46*b* is established between the two steel grip shoes 20. Therefore, when the imager 14 (FIG. 1) is brought near the grip face 18 and further when the steel poles 42 are in the position shown in the view of FIG. 10*b*, then the second magnetic flux path 46*b* will run through the substrate 16 (FIG. 1) of the imager 14 and the imager 14 will be held to the grip face 18. When the knob 40 is rotated to place the steel poles 42 as shown in the view of FIG. 10*a*, then the path of least resistance for the second magnetic flux path 46*a* is established, as shown, through the steel grip shoes 20, and the imager 14 is released from the grip face 18.

Referring back to FIG. 2, retainer 26 limits the travel of armature assembly 22 as follows. A arcuate notch 35 in retainer 26 defines the range of motion of armature assembly 22. An extension (not shown) formed in the bottom of one of grip shoes 20 engages a first end of notch 35 when armature assembly 22 is rotated in one direction, and engages a second end of notch 35 when armature assembly 22 is rotated in a second direction. The angular measure of arcuate notch 35 determines the angle through which armature assembly 22 can be rotated. It should be noted that this travel limiting feature of this embodiment is an optional feature, and could be replaced, for example by simply providing relative position markings on armature assembly 22 and on one or both of grip shoes 20 or frame 24.

Various modifications may be made to the invention without altering its value or scope. For example, the size, shape, and placement of components described herein may each or all be varied according to the requirements of the particular application. As a further example, an electro-magnet may be substituted for the permanent magnet shown in the particular embodiment presented in drawings. The use of an electro-magnet advantageously eliminates the need to rotate the magnet and to shunt the magnetic field in the off position, because the magnetic field of an electromagnet can be switched simply by providing or disrupting electrical current to the magnet.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

Industrial Applicability

The inventive improved magnetic chuck 10 is intended to be widely used in the construction of projection type imaging devices. Currently, the invention is being applied to the construction of multi channel imaging devices using reflective type LCD devices such that three of the improved imager assemblies 10 are employed in each such device. However, it is within the scope of the invention that other types of display devices (not shown) could be employed, and other types of imaging engines constructed, according to the present inventive method.

The inventor has discovered that application of the present invention provides for imaging devices to be fixtured more quickly and more firmly for convergence operations, as compared to prior art methods and apparatus. The imaging devices can also be released more quickly and easily. According to the present invention, the magnetic chuck 10 can be turned on or off with the simple turn of the knob 40, thereby readily facilitating the holding of the small imager which would otherwise be difficult to hold and manipulate.

Since the improved magnetic chuck 10 of the present invention may be readily produced and integrated with existing video creation and display assembly systems and devices, and since the advantages as described herein are provided, it is expected that it will be readily accepted in the industry. For these and other reasons, it is expected that the utility and industrial applicability of the invention will be both significant in scope and long-lasting in duration.

I claim:

1. A holding apparatus for temporarily securing an imager having a ferro-magnetic component, said apparatus comprising:

a grip face adapted to abut said imager; and a magnet disposed to selectively, magnetically engage said ferro-magnetic component of said imager by altering the magnetic field relative to the grip face.

2. The holding apparatus of claim 1, wherein:

said magnet is a permanent magnet; and further comprising a handle coupled to said magnet for rotating said magnet between an on position and an off position; and a magnetically permeable shunt path for shunting magnetic flux therethrough when said magnet is rotated to said off position.

3. The holding apparatus of claim 2, wherein:

said shunt path includes two ferro-magnetic blocks spaced apart from one another;

a portion of each of said blocks forms a portion of said grip face; and each of said blocks at least partially encircles said magnet.

4. The holding apparatus of claim 3, wherein:

said permanent magnet is shaped as a rectangular solid having at least one flat pole face.

5. The holding apparatus of claim 4, and further including:

a cylindrical pole piece disposed adjacent said flat pole face.

6. The holding apparatus of claim 2, wherein:

said magnet is held in an armature assembly.

7. The holding apparatus of claim 6, wherein:

the armature assembly includes a non-magnetic shaft.

8. The holding apparatus of claim 6, wherein:

said handle is affixed to the armature assembly such that the armature assembly can be manually rotated by the action of rotating said handle.

9. The holding apparatus of claim 6, wherein:

said magnet is held within a shaft of the armature.

10. The holding apparatus of claim 9, further comprising:

two cylindrical pole pieces, one of said pole pieces disposed adjacent a first pole face of said magnet, and the other of said pole pieces disposed adjacent a second pole face of said magnet.

11. The holding apparatus of claim 6, wherein:

the imager is held by magnetic flux against a grip face when the armature assembly is rotated to an on position.

12. A magnetic chuck for holding an imager, comprising:

a non ferromagnetic housing;

two ferromagnetic blocks affixed to said housing; and a magnet rotatably affixed between said blocks such that a magnetic field can selectively be routed through said blocks or between said blocks.

13. The magnetic chuck of claim 12, and further including:

a grip face positioned such that when the magnetic field is routed between said blocks then the magnetic field passes across the grip face.

14. The magnetic chuck of claim 12, and further including:

a knob for manually rotating said magnet.

15. The magnetic chuck of claim 12, wherein:

said housing is made of aluminum.

16. The magnetic chuck of claim 12, further comprising:

a magnetic armature at least partially surrounded by said blocks.

17. The magnetic chuck of claim 16, wherein:

the armature includes a non ferromagnetic shaft at least partially enclosing said magnet.

18. The magnetic chuck of claim 17, and further including:

at least one pole piece adjacent to said magnet.

19. The magnetic chuck of claim 18, wherein:

the quantity of pole pieces is two.

20. The magnetic chuck of claim 12, wherein:

said magnet flux from said magnet is routed through said blocks when said magnet is rotated to an off position.

21. A magnetic chuck for positioning an imager assembly, said magnetic chuck comprising:

a contact surface for engaging said imager assembly; and means for selectively generating a magnetic field through said contact surface to attract said imager assembly to hold said imager assembly to said contact surface.

22. The magnetic chuck of claim 21, wherein: said means for generating a magnetic field to attract said imager assembly includes:

a magnetic shunt path; and means for selectively directing said magnetic field through said shunt path.

23. A method for mounting an imager assembly to another apparatus, said method comprising:

magnetically coupling said imager assembly to a positioning device;

positioning said imager with respect to said other apparatus with said positioning device;

fixing said imager with respect to said other apparatus; and disengaging said imager from said positioning device.

24. The method of claim 23, wherein:

said step of magnetically coupling said imager assembly to said positioning device includes directing a magnetic field to attract said imager assembly; and said step of disengaging said imager includes redirecting said magnetic field through a shunt path.

25. The method of claim 23, wherein:

said imager assembly includes a pixilated imaging device mounted to a front surface of a ferro-magnetic substrate; and said step of magnetically coupling said imager assembly to a positioning device includes magnetically engaging a rear surface of said substrate.

26. The holding apparatus of claim 1, wherein the selective magnetic engagement is provided by the ability to change at least one of the direction and strength of the magnetic field of said magnet.

27. A holding apparatus for temporarily securing an imager mounted to a front side of a substrate, said apparatus comprising:

a grip face adapted to abut a back side of said substrate; and a magnet disposed to selectively, magnetically engage said back side of said substrate through said grip face by altering the magnetic field relative to the grip face.

* * * * *